US011796275B2

(12) United States Patent
Bascom

(10) Patent No.: US 11,796,275 B2
(45) Date of Patent: Oct. 24, 2023

(54) AUTO-LOADING FIREARM WITH SELECTABLE LIVE FIRE AND TRAINING MODES

(71) Applicant: Mustang Industrial Design, Inc., Plano, TX (US)

(72) Inventor: Brian Bascom, Plano, TX (US)

(73) Assignee: Mustang Industrial Design, Inc., Plano, TX (US)

( * ) Notice: Subject to any disclaimer, the term of this patent is extended or adjusted under 35 U.S.C. 154(b) by 0 days.

(21) Appl. No.: 17/665,569

(22) Filed: Feb. 6, 2022

(65) Prior Publication Data

US 2022/0325977 A1 Oct. 13, 2022

Related U.S. Application Data

(63) Continuation of application No. 17/031,725, filed on Sep. 24, 2020, now Pat. No. 11,320,229, which is a continuation of application No. 16/401,045, filed on May 1, 2019, now Pat. No. 10,809,035, which is a continuation of application No. 16/070,246, filed as application No. PCT/US2016/013294 on Jan. 13, 2016, now Pat. No. 10,436,540.

(51) Int. Cl.

| | |
|---|---|
| ***F41A 33/06*** | (2006.01) |
| ***F41A 19/06*** | (2006.01) |
| ***F41A 33/00*** | (2006.01) |
| ***F41A 17/56*** | (2006.01) |
| ***F41A 19/12*** | (2006.01) |

(52) U.S. Cl.
CPC ..... *F41A 33/06* (2013.01); *F41A 17/56* (2013.01); *F41A 19/06* (2013.01); *F41A 19/12* (2013.01); *F41A 33/00* (2013.01)

(58) Field of Classification Search
CPC ..... F41A 17/56; F41A 19/12; F41A 30/00; F41A 30/06
USPC ..... 89/128; 42/70.04, 70.05
See application file for complete search history.

(56) References Cited

U.S. PATENT DOCUMENTS

| | | | | |
|---|---|---|---|---|
| 10,436,540 | B2 * | 10/2019 | Bascom | F41A 19/06 |
| 10,809,035 | B2 * | 10/2020 | Bascom | F41A 33/06 |
| 11,320,229 | B2 * | 5/2022 | Bascom | F41A 33/06 |
| 2010/0275491 | A1 * | 11/2010 | Leiter | F41A 21/26 42/76.01 |
| 2013/0118050 | A1 * | 5/2013 | Alicea | F41A 19/58 42/84 |
| 2015/0013201 | A1 * | 1/2015 | Hannan | F41A 19/01 42/20 |
| 2016/0178303 | A1 * | 6/2016 | Macy | F41A 19/10 124/31 |
| 2016/0258706 | A1 * | 9/2016 | Ollig | F41A 33/00 |
| 2017/0268845 | A1 * | 9/2017 | Jakob | F41A 33/06 |
| 2018/0321006 | A1 * | 11/2018 | Biran | F41A 9/65 |

* cited by examiner

*Primary Examiner* — Bret Hayes
(74) *Attorney, Agent, or Firm* — Peter V. Schroeder; Booth Albanesi Schroeder, PLLC

(57) ABSTRACT

An auto-loading firearm having a live fire mode, in which the firearm operates to discharge, and a training mode in which the firearm does not discharge. In the training mode, the firearm provides for resetting the trigger after simulated firing of the firearm.

18 Claims, 14 Drawing Sheets

AUTO-LOADING FIREARM WITH SELECTABLE LIVE FIRE AND TRAINING MODES

TECHNICAL FIELD

The present disclosure relates to generally to firearms, and more specifically to auto-loading firearms, including fully automatic and semiautomatic firearms. The disclosure presents apparatus and methods for auto-loading firearms having a live fire mode and a non-live fire, training mode.

BRIEF DESCRIPTION OF THE DRAWING

For a more complete understanding of the features and advantages of the present disclosure, reference is now made to the detailed description of the disclosure along with the accompanying figures in which corresponding numerals in the different figures refer to corresponding parts and in which:

FIG. 3A is a left elevational, sectional view of the firearm in training mode and with the trigger in a home position, the firearm having a training system according to an aspect of the disclosure. FIG. 3B is a right elevational, sectional view of the firearm in training mode and with the trigger in a home position.

DETAILED DESCRIPTION OF EMBODIMENTS OF THE DISCLOSURE

Figure 1:
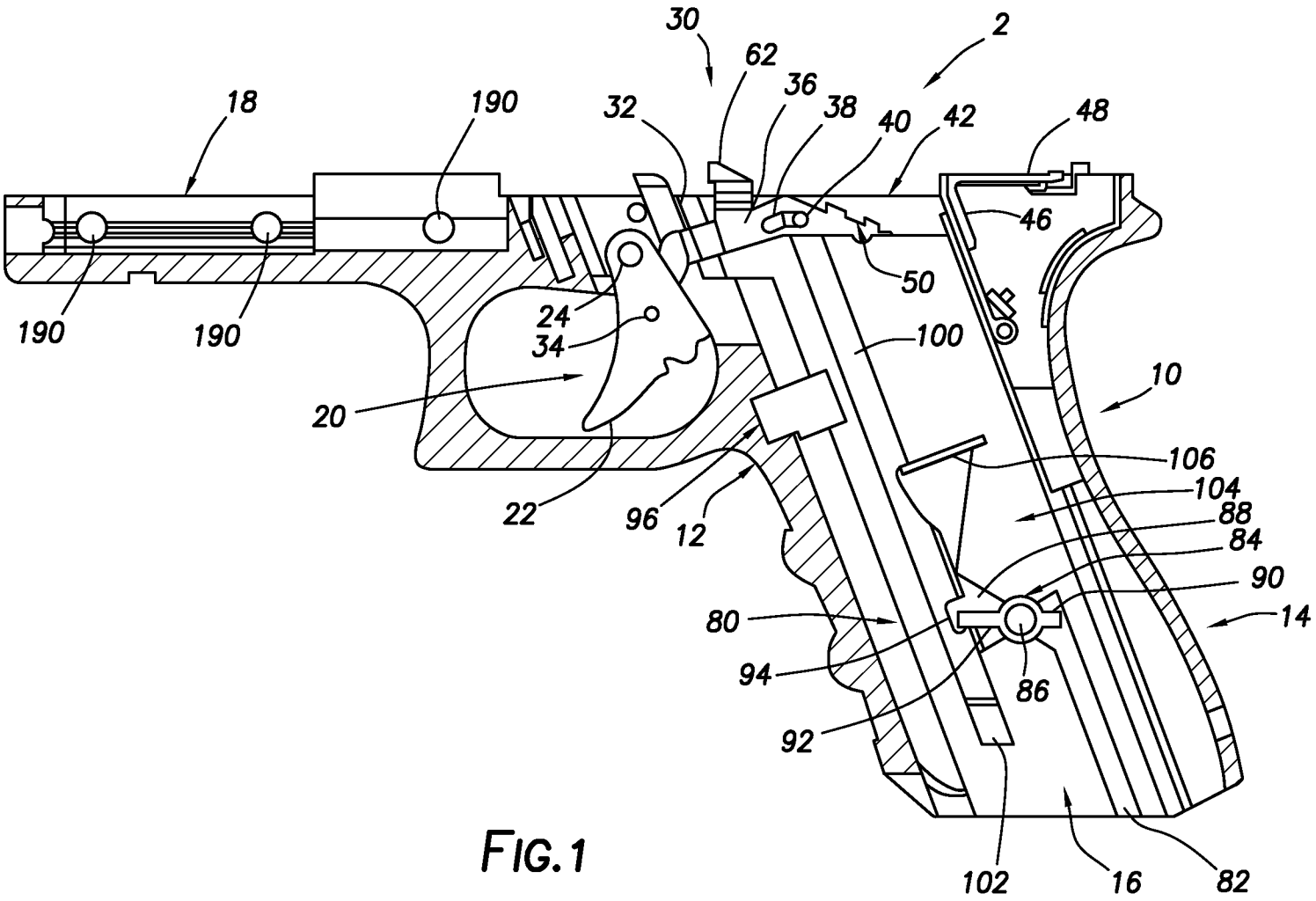
FIG. 1 is an elevational, sectional view of the left side of an exemplary auto-loading firearm in live fire mode and with the trigger in a home, or not depressed, position, the firearm having a training system according to an aspect of the disclosure.

The present disclosures are described by reference to drawings showing one or more examples of how the disclosures can be made and used. In these drawings, reference characters are used throughout the several views to indicate like or corresponding parts. In the description which follows, like or corresponding parts are marked throughout the specification and drawings with the same reference numerals, respectively. Drawings may not be to scale.

The disclosed apparatus and methods relate specifically to auto-loading firearms, including fully automatic and semi-automatic firearms. These firearms typically include: a frame, a barrel assembly, a receiver assembly, a magazine (either fixed or removable), and a trigger assembly. The trigger assembly typically includes a trigger, a trigger bar, and a sear that either releases a hammer that strikes a firing pin or releases a biased striker. The firing pin strikes a chambered cartridge discharging the firearm. Alternate firing methods are less often implemented, including electronic ignition, or a sear-driven linkage in place of the trigger bar.

The term "auto-loading firearm" and similar as used herein refers only to self-reloading, semiautomatic and fully automatic firearms. Revolvers and bolt action rifles are specifically excluded from the discussion and disclosure herein. Both revolvers and bolt action rifles have dry-fire modes indistinguishable from live-fire modes and the disclosed methods and apparatus are unnecessary for such firearms.

Auto-loading firearm models, whether semiautomatic, fully automatic, exclusively single-action, exclusively double-action, or selectively double-action/single-action, have a single mode of operation, namely a live-fire mode. Normal operation of the firearm can be prevented by switching on a safety mechanism in firearms so equipped. The firearm can be selectively positioned from live to safe using mechanisms such as magazine drop safeties, grip safeties, trigger safeties, and manual interrupt safeties.

Training is required for safe and effective operation of a firearm, preferably including use of the firearm in a non-live fire mode where the firearm is not loaded with any rounds of ammunition. Presented herein are apparatus and methods of using a "training mode" of firearm operation. Training mode allows full functionality simulation to the user while also disabling potential live-fire operation.

The most common non-live fire training option is a practice called "dry fire." This practice is used by shooters to develop trigger control, e.g., by detecting unwanted firearm movement in the sight planes (i.e., up, down, left, right) without having to contend with firearm recoil and report. Dry firing is a manual process requiring cocking of the firearm's hammer or striker mechanism (without a live round in the firearm), taking aim, and pulling the trigger to simulate firing the firearm. The process is repeated (manually cock, aim, pull trigger) to take additional practice "shots." Only a single simulated shot is "fired" with each cycle. For single-action auto-loading firearms, this training practice is not realistic, given the semi-automatic nature of the firearm, nor effective in creating muscle memory and skill. For selectively double-action/single-action firearms such training practice is also not realistic, as the longer and heavier initial trigger pull must be repeated in each instance, or the hammer or striker mechanism manually reset by the person performing dry firing, to allow practice using the lighter single-action trigger pull. Additionally, there is a negative training impact in the use of a training system only allowing a single shot and recycle procedure.

Other common training options include aiming practice without any trigger pull or live fire, firearm retention practice in close-combat training, and practice drawing from a standard or concealed holster, typically coupled with aiming practice. Each of these practices has limitations in some combination of the following: lack of realistic firearm operation, lack of firearm feedback, lack of skill development, and lack of obvious safety status indication to the person practicing or to any other persons near them.

To overcome these limitations, training mechanisms are often used in place of or in conjunction with the training options outlined above. Training mechanisms include: firearm replacement (firearm simulators/simulation), the addition of training components to the firearm, and modifications to the firearm. Each of these options suffers limitations. Firearm replacements fall into two broad categories, non-functional firearm simulators and limited functionality firearm simulators.

Non-functional firearm simulators are used in firearm retention training in close-combat situations. They lack shooting functionality but provide a more durable platform than limited functionality simulators and a safer platform than actual firearms when practicing hand-to-hand combat. The lack of functionality limits the realism of the training by eliminating manipulation of the safety mechanism during close-combat exercises and failing to provide feedback (recoil, report) to indicate firearm discharge during close-combat exercises.

Limited functionality firearm simulators are a category of simulators that mimic one or more of the normal operations of the firearm. The most common features are simulated firearms that contain self-resetting triggers and laser emitters that show where the simulated firearm is aimed when the trigger is pressed. Such simulators mimic only a subset of the spectrum of available firearms. Further, such simulators fail to provide some or all of the following: feedback in the form or recoil and report, realistic feedback of trigger pull and reset, realistic magazine release and replacement, and practice with the same accessories the person training ordinarily uses (e.g., grip inserts, tritium sights, magnifying/optical sights).

Add-on training components include external components to interrupt or limit trigger functionality or simulate targeting and delivery. These add-on components exhibit shortcomings such as failure to prevent live-round insertion and discharge, modifying the normal operational cycle of the firearm to include unrealistic actions, changing the profile of the firearm so it is no longer able to be properly holstered, requiring time and expertise to modify the firearm before training, and changing the weight and balance of the firearm which negatively impacts muscle memory during aiming and firing.

Finally, modification of the existing firearm is available for training and involves use of after-market parts and components to alter the firearm. Such modification has limitations including voiding of the firearm warranty, damage to the firearm, removal of manufacturer approved components, limited model selection of aftermarket training components, lack of feedback recoil and sound, lack of realistic feedback in trigger pull and reset, and lack of functionality in magazine release and replacement.

The disclosed apparatus and methods address limitations of current training options, providing training with an operable auto-loading firearm, having similar weight, balance and configuration as in live mode, realistic feedback in trigger pull and reset, and full functionality of the auto-loading firearm as in live fire mode except for actual firing and delivery of a round. The disclosure also addresses realistic feedback recoil and sound. An embedded or inherent training system, which is part of the auto-loading firearm, allows seamless transition from a live-fire mode to a training mode wherein secondary safety features are implemented. In an embodiment, an affirmative action by the user (e.g., cycling the load mechanism, pressing the trigger forward, or resetting of the trigger) is required to return the firearm to live-fire mode after use in training mode.

A specific auto-loading firearm utilizing the embedded training system incorporates selectable firing and training modes, with selection performed by a mechanical mode selector movable between a live fire position and a training position. Activation of the mode selector switches the system between the modes.

In live fire mode, the firearm's internal system is configured such that the trigger connects through a transfer bar or other mechanisms to the sear to release the hammer, firing pin, or striker. This configuration is analogous to standard operation of an auto-loading firearm which does not utilize the training system. In an embodiment, the system remains in live fire mode until a specialized training attachment is selectively attached to the firearm.

In training mode, the firearm's internal system is configured such that the trigger is no longer connected through a transfer mechanism to the sear, and consequently to the hammer or striker, but is instead connected through a transfer bar or other mechanisms to a trigger-resetting system. In training mode the firearm is inoperable to release the hammer, firing pin, or striker, and cannot fire a round.

The firearm remains in training mode as long as the mode selector switch is kept in the training mode position. For example, in some embodiments, the firearm remains in training mode only while a specialized training attachment, such as a training "magazine," remains properly attached to the firearm. The firearm training system reverts to live fire mode when the mode selector switch is moved to the live fire position. In some embodiments, reversion to live fire mode is performed by user-manipulation of a mechanism (e.g., switch, lever), while in others reversion occurs with detachment of the training attachment (e.g., removal of the training magazine). In an embodiment, the system only reverts to live fire mode after an ammunition loading mechanism is manually activated or the trigger pressed forward (after removal of the training attachment) to prevent accidental discharge. In other embodiments, the system reverts to live fire mode automatically upon detachment of the training attachment and consequent activation of the mode selector.

As used herein "training magazine" and the like are used to indicate an attachable and detachable training device, or training attachment, which releasably attaches to the firearm via the magazine well of the firearm. It is understood that the "training magazine" does not contain live or blank ammunition rounds.

Activation of the mode selector is performed by any mechanism capable of acting as or manipulating a lever, including manual, hydraulic, electric, electromagnetic, or inertial mechanisms. In an embodiment, selection of training mode is performed by and dependent upon proper attachment of a training attachment designed for that purpose. Upon attachment to the firearm, the training attachment automatically moves the mode selector to the training mode position. In an embodiment, the training attachment is specially designed to activate the mode selector; that is, upon attachment, the training attachment automatically switches the system to training mode and, upon detachment, the mode selector returns the system to the live fire mode. The training attachment may further comprise a trigger-resetting mechanism used in the training mode.

The training attachment, in some embodiments, comprises a specialized training magazine. Alternate embodiments can include, for example, external devices selectively attachable and detachable from the firearm such as an external device selectively mountable on Picatinny or accessory rails on the firearm, in the grip panels, or as part of or comprising an external, removable handguard.

Figure 2:
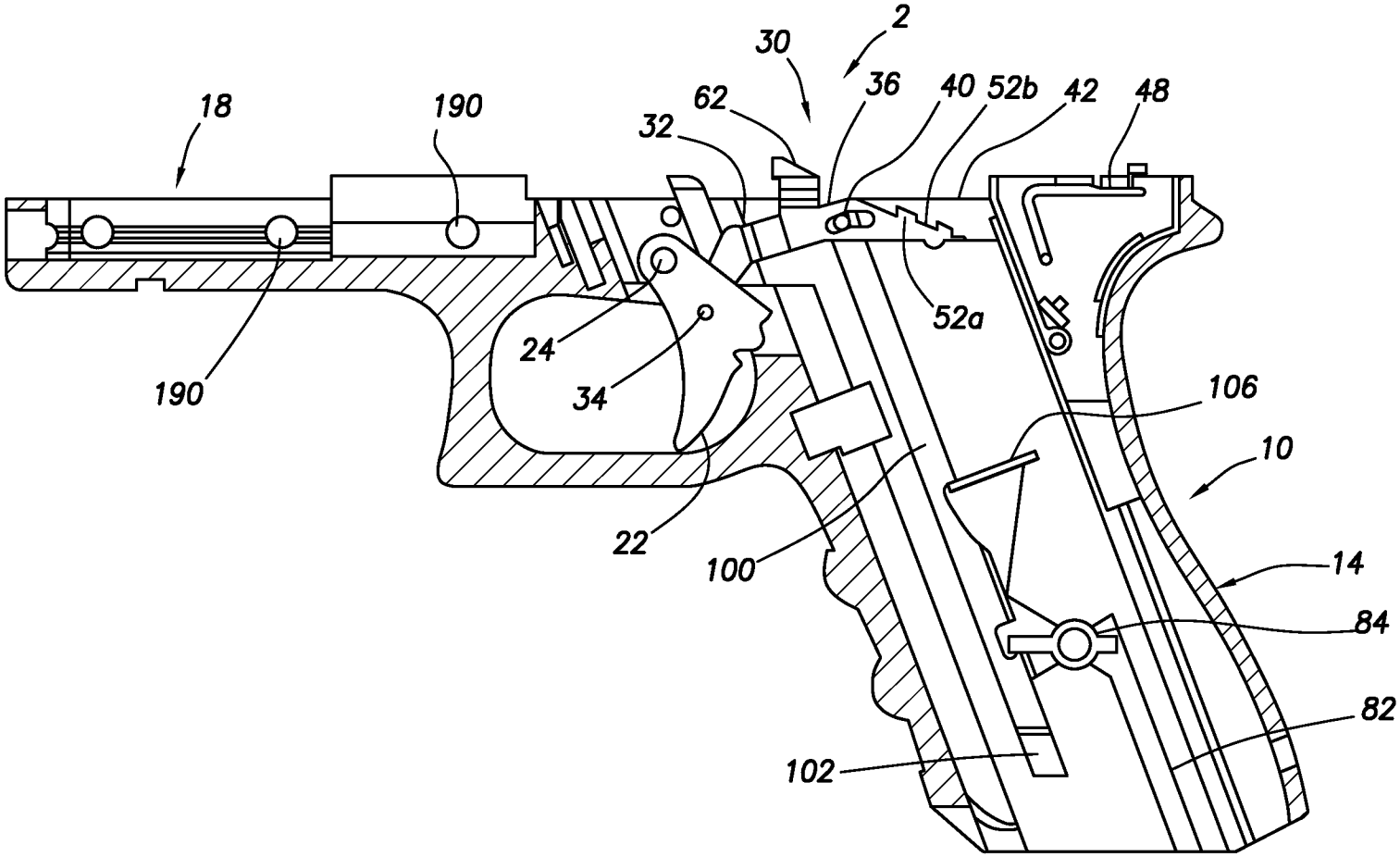
FIG. 2 is a left elevational, sectional view of the exemplary auto-loading firearm of FIG. 1 in live fire mode and with the trigger depressed, the firearm having a training system according to an aspect of the disclosure.

FIG. 1 is a left elevational, sectional view of an exemplary auto-loading firearm in live fire mode and with the trigger in a home, or not depressed, position, the firearm having a training system according to an aspect of the disclosure. FIG. 2 is a left elevational, sectional view of the exemplary auto-loading firearm of FIG. 1 in live fire mode and with the trigger depressed. The FIGS. 1 and 2 are discussed together.

The auto-loading firearm 10 has a frame 12 defining a grip 14, barrel 18, trigger guard 20, and supports for the internal and external mechanisms of the firearm. The grip 14 defines a magazine cavity for insertion of a detachable magazine 16. Not shown are cartridges and followers positioned in the magazine for feeding rounds into the firing chamber.

The firearm 10 includes elements of the training system, generally designated 2, as well as common operable elements found in auto-loading firearms. Typical firearm elements such as firing pins and the like may not be discussed as they are common in the art and understood by practitioners of the art.

Attached to and partially housed by the frame 12 is a trigger assembly 20 having a trigger 22, trigger pivot 24, and optionally a trigger return spring and cooperating return spring channel (not shown). The trigger pivot 24 is commonly a pin extending laterally through the trigger 22 and rotatably attached to the frame 12. The trigger 22 is seen in a home position (not depressed). The trigger 22 rotates to a depressed position, FIG. 2, when activated by the user. The trigger, trigger mount, trigger return spring, and cooperating return spring channel can be of various types and configurations, as is known in the art. Some auto-loading firearms do not employ a trigger return spring.

The firearm further includes a transfer bar assembly 30 connecting the trigger assembly 20 to the connector 46 and sear 48. The transfer bar assembly 30 can be a trigger bar assembly as seen in FIG. 1. In other firearm designs, the trigger interacts directly with the hammer or striker, with the sear incorporated into the trigger. In still other designs, a firearm sear and transfer bar are incorporated into a single component. Further, it is understood that a firearm can have a series of components that function, in aggregate, as a transfer bar or trigger bar. The principles disclosed herein in relation to the "split" or two-component trigger bar design can be applied to these alternate firearm designs.

The exemplary training trigger bar 36 includes an elongate opening or groove 38 which cooperates with a trigger bar pin 40 extending laterally from the firearm frame 12 into or through the opening or groove 38. The cooperation of the pin and groove allows the training trigger bar to slide longitudinally relative to the frame. The groove can be linear or curvate depending on firearm design. The exemplary trigger bar assembly includes a trigger bar lead 32 attached to the training trigger bar 36.

A firing trigger bar 42 is selectively joined to the training trigger bar 36. The firing trigger bar 42 cooperates with the training trigger bar at one end and with the connector 46 and sear 48 at the other end. In live mode, as seen in FIG. 1, the training trigger bar and firing trigger bar abut and cooperate with one another such that they move simultaneously. That is, movement of the training trigger bar rearward, caused by depression of the trigger, pushes the firing trigger bar rearward as well. Movement of the firing trigger bar 42 rearward results in activation of the sear 48 by the firing trigger bar 42, as best seen in FIG. 2. Similarly, reset movement of either the firing trigger bar or the training trigger bar results in movement of both trigger bar elements to their original positions. Reset movement of the training and/or firing trigger bars can be by any reset mechanism known in the art, such as a trigger reset spring, trigger bar reset spring, recoil, gravity, eccentric cams, magnets or electromagnets, hydraulic or pneumatic return mechanisms, or the like.

The training and firing trigger bars jointly cooperate to form a "split" trigger bar. The training and firing trigger bars 36 and 42 are releasably attachable to one another along a joint 50 and selectively movable relative to one another. The trigger bars move between a joined position, as seen in FIGS. 1-2, to a split or disconnected position, as seen in FIGS. 3-4 as will be explained herein.

An exemplary cooperating joint 50 comprises teeth 52*a* defined on the training trigger bar 36 and cooperating and interlocking teeth 52*b* defined on the firing trigger bar 42. These features on the training trigger bar can be more easily seen in FIGS. 5-6. The cooperating teeth 52 of joint 50, when in the live fire position seen in FIG. 1, serve to provide a stable abutment between the firing and training trigger bars such that a pushing force applied to one is transferred to the other, and such that, when moving in response to such a force, the firing and training trigger bars move together as a unit. The faces of the interlocking teeth serve, in part, to align the firing and training trigger bars upon movement into the live fire position and to maintain alignment during firing. Surfaces of the teeth serve to transfer force between the bars during use. Preferably such surfaces are generally perpendicular to the direction of the applied force although other designs can be used. In the illustrated embodiment, the teeth have faces which transfer a rearward force on the training transfer portion to the firing transfer portion and faces which transfer a pulling, forward force on the training transfer portion to the firing transfer portion. That is, movement of one transfer portion results in movement of the other portion regardless of direction of the force (forward or backward) or on which portion the force is applied. In alternate designs, linking pins, gears, friction plates, magnetic or hydraulic coupling, or electromechanical actuation can serve to transfer force between the firing and training trigger bars.

The firearm of FIGS. 1-2 is in live fire mode, wherein the internal mechanisms of the firearm are configured such that the trigger 22 connects through a trigger bar assembly 30 to the sear 48 to release the firing pin or striker. The system is in live fire mode unless the selector switch 100 is forcibly moved into training mode. In the exemplary case the selector switch 100 is forced in to training mode when a specialized training attachment is selectively attached to the firearm and returns to live fire mode when such specialized training attachment is removed from the firearm.

Figure 3A:
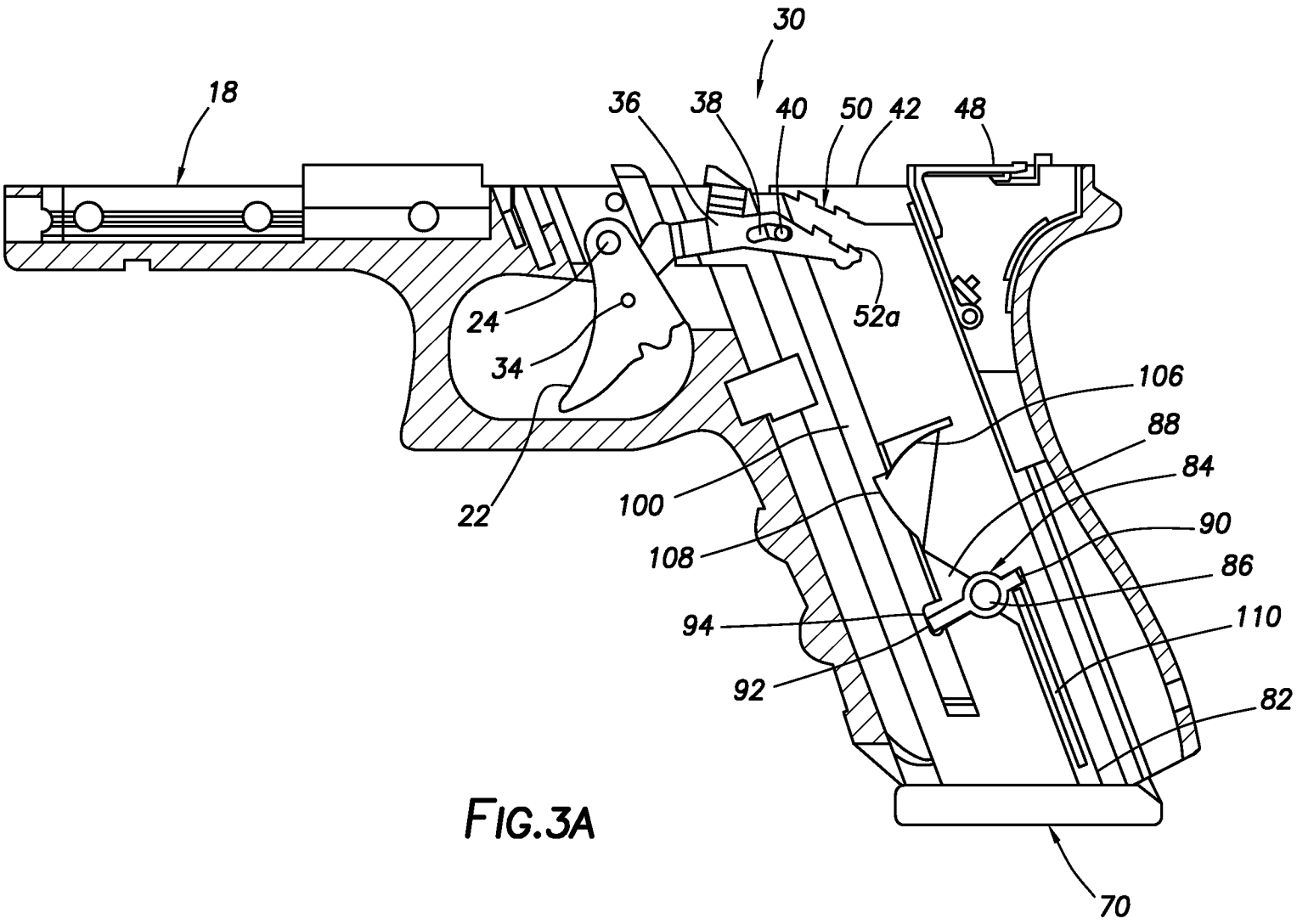
FIGS. 3A-B are elevational, sectional views of the auto-loading firearm of FIGS. 1-2 in a training mode according to an aspect of the disclosure. More specifically.
Figure 3B:
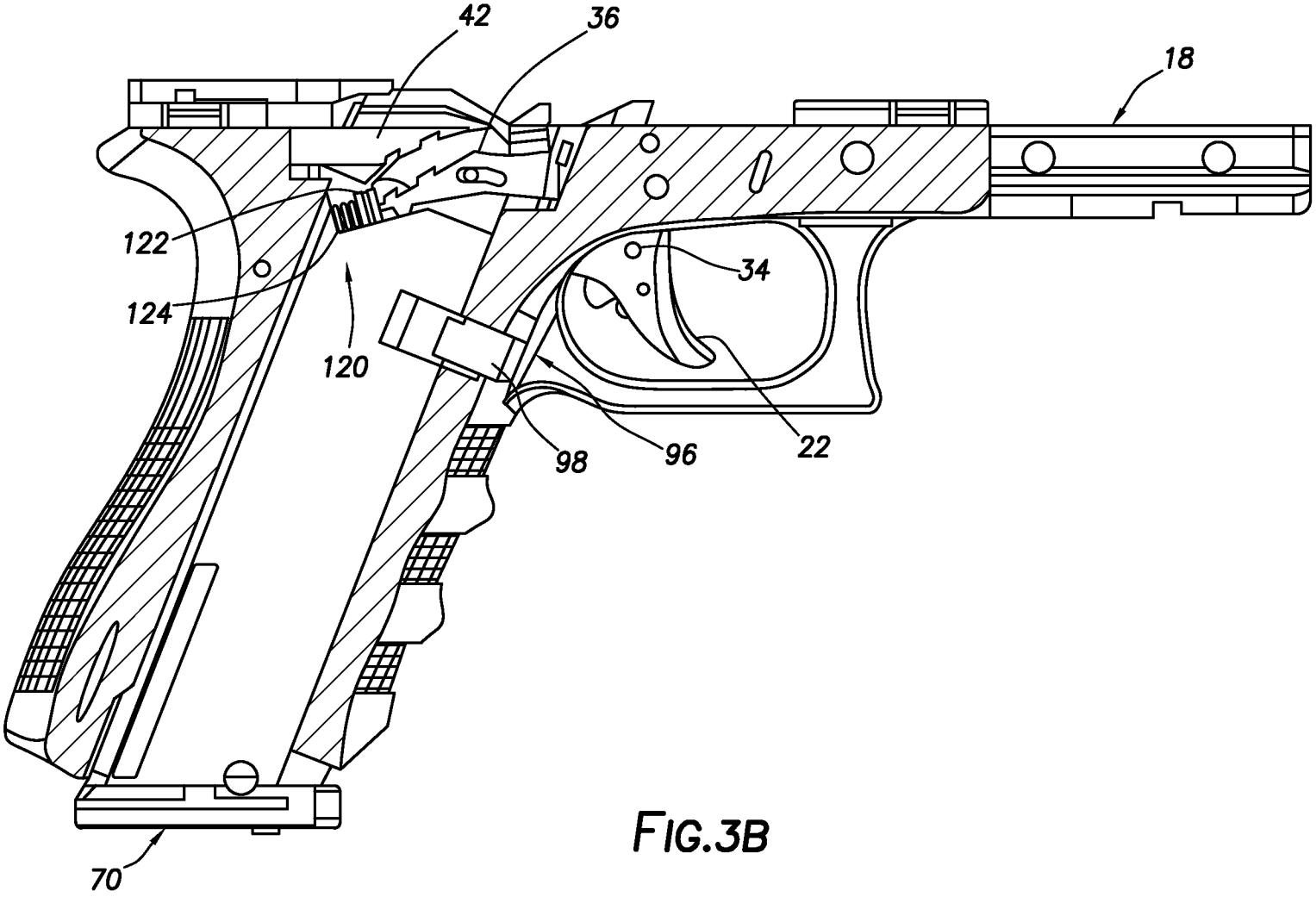
Figure 4:
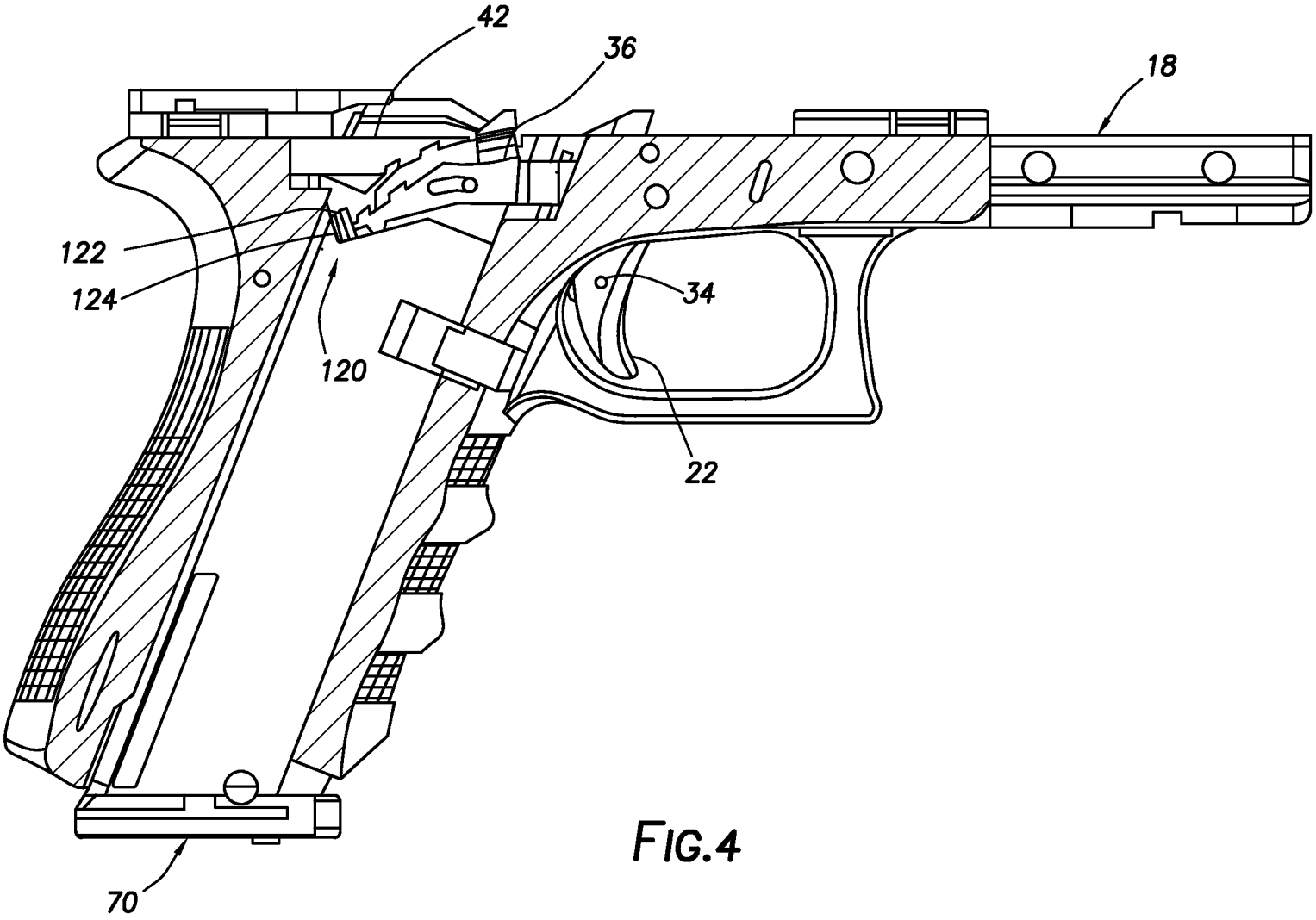
FIG. 4 is a right elevational, sectional view of the firearm in training mode and with the trigger depressed.

FIGS. 3A-B are elevational, sectional views of the auto-loading firearm of FIGS. 1-2 in a training mode according to an aspect of the disclosure. More specifically, FIG. 3A is a left elevational, sectional view of the firearm in training mode and with the trigger in a home position, the firearm having a training system according to an aspect of the disclosure. FIG. 3B is a right elevational, sectional view of the firearm in training mode and with the trigger in a home position. FIG. 4 is a right elevational, sectional view of the firearm in training mode and with the trigger depressed. The FIGS. 3-4 are discussed together.

The firearm in FIGS. 3-4 is in training mode, wherein the internal mechanisms of the firearm are configured such that the trigger 22 does not connect through the trigger bar assembly 30 to the connector 46 to release the firing pin or striker. The system is placed in training mode by moving the selector switch 100 into a training mode position. In the embodiment shown, the selector switch 100 is moved upwards into training mode position by selectively attaching a specialized training attachment to the firearm. In the embodiment shown, the training attachment is a training magazine, as will be explained further herein.

FIGS. 3A-B show the firearm in training mode with the split trigger bar assembly 30 activated and moved such that the training trigger bar 36 and the firing trigger bar 42 are in spaced apart relationship and such that operation of the firearm in training mode does not result in movement of the firing trigger arm 42. More specifically, the training trigger bar 36 is moved downward by rotation of the training trigger bar 36 about trigger bar pivot 34. The drop-safety disengage 62 moves with the training trigger bar. The trigger 22 is in the home position, which is, in this embodiment, the identical location as in live fire mode. Note also that the pin 40 and groove 38 can also relatively move in response to movement of the training trigger bar 36 to the training position.

FIG. 4 shows the firearm in training mode with the trigger 22 depressed. Movement of the trigger 22 about the trigger pivot 24 causes responsive movement of the training trigger bar 36 and trigger bar lead 32, just as in live mode. However, the training trigger bar 36 is not in contact with the firing trigger bar 42 along joint 50 and, consequently, the firing trigger bar does not activate the sear 48 or connector 46, and in the shown embodiment remains stationary.

As stated above, the exemplary training attachment 70 operates to switch the firearm from live fire mode to training mode upon assembly of the training attachment onto the firearm. The training attachment can take various designs according to aspects of the disclosure. The exemplary training attachment seen inserted into the magazine retainer in the grip 14 of the firearm in FIGS. 3-4 is a training magazine 70. A live magazine 16 is seen inserted into the magazine retainer in the grip of the firearm in FIGS. 1-2. Visible in these figures are elements of the training system embedded in the firearm which interact with the training magazine.

Turning to FIGS. 1-2, a selector assembly 80 includes a transfer mechanism 84 movable between a live and training position. In the shown embodiment, the transfer mechanism 84 is a lever rotatably mounted on a transfer pivot 86 supported by the frame 12. The transfer lever 84 can freely rotate within a transfer lever cavity 88 defined in the firearm frame. The transfer lever 84 is in a home or live fire position in FIGS. 1-2. The transfer lever 84 has opposed arms with one lever arm 90 aligned with and extending into a push bar channel 82. The opposite arm 92 extends into a transfer lever catch 94 defined in the selector switch 100 and having upper and lower shoulders for engaging the lever arm 92.

The selector switch 100 is an elongated rod extending between the transfer lever 84 and the trigger bar pin 40. The trigger bar pin 40 is attached to the selector switch 100 and movable between a live fire position and a training position. In the embodiment shown, the selector switch 100 is mounted for sliding movement in a corresponding selector switch channel 102. The selector switch 100 and the attached trigger bar pin 40 move together, generally upwardly and downwardly.

A selector switch biasing assembly 104 preferably operates to bias the selector switch 100 towards its live fire position. The live fire position is thus the default position for the selector switch 100. The biasing assembly includes a bias catch 106 which cooperates with a biasing mechanism 108. In the illustrated embodiment, the biasing mechanism 108 includes a biasing spring mounted to the interior of the grip 14 at retainer 109. The shown bias catch 106 is a simple shoulder defined in the selector switch 100 which engages the biasing spring.

Insertion and removal of a live magazine into the magazine cavity does not activate or otherwise operate the selector switch 100 or transfer mechanism 84. The live magazine interacts with a cooperating magazine catch and release assembly 96 having a magazine release switch, button or lever 98, in any manner known in the art.

In FIG. 3A, training magazine 70 is seen inserted into the firearm. Manual positioning of the training magazine 70 into the magazine cavity causes a push bar 110, integral to or mounted on the training magazine, to slide upward along the push bar channel 82. At or near the upper end of the push bar channel 82, the push bar 110 activates the transfer lever 84 by engaging the lever arm 90 and causing rotation of the transfer lever. Rotation of the lever causes movement of lever arm 92 which engages the lower shoulder of the transfer lever catch 94 forcing the selector switch 100 downward.

Downward movement of the selector switch causes corresponding downward motion of the trigger bar pin 40 which acts upon the groove 38 and pulls the training trigger bar down, out of engagement with the firing trigger bar 42, and into the training position as shown. As the selector switch 100 moves downwardly, the bias catch 108 engages and loads the biasing spring 106 to return the selector switch to firing mode when it is no longer forced into the training mode position by the push bar 110. That is, the selector switch biasing assembly moves the selector switch from the training to the live fire position when the training attachment is removed and thus no longer maintains the selector switch in the training position.

The auto-loading firearm 10 can further include a safety mechanism utilizing the split trigger bar capabilities. A drop-safety disengage switch 62 connects to or is integral with the training trigger bar 36.

Traditional safeties can also be used as with known auto-loading firearms, including those which are slide, frame, trigger or grip mounted, lever, pivot, or push activated, and which can act upon the trigger, trigger bar, sear or disconnect, hammer, firing pin, or within the magazine. Operation of the traditional safety is not effected by switching between live and training modes. That is, one or more traditional safeties are operable by the user when the firearm is in training mode, providing a realistic training experience.

Figure 5:
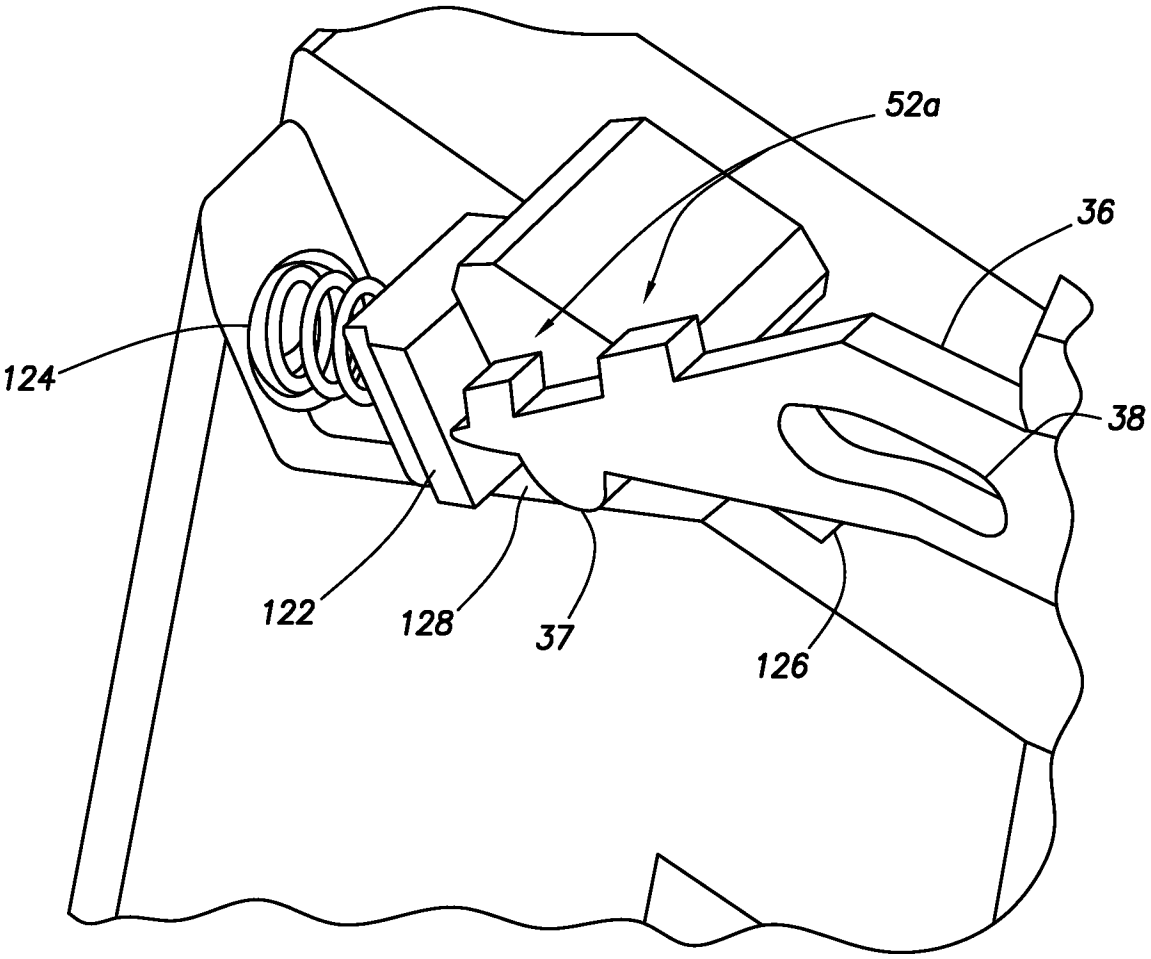
FIG. 5 is a partial detail of selected elements of an exemplary training track assembly for use with the auto-loading firearm of FIGS. 1-4 according to aspects of the disclosure.
Figure 6:
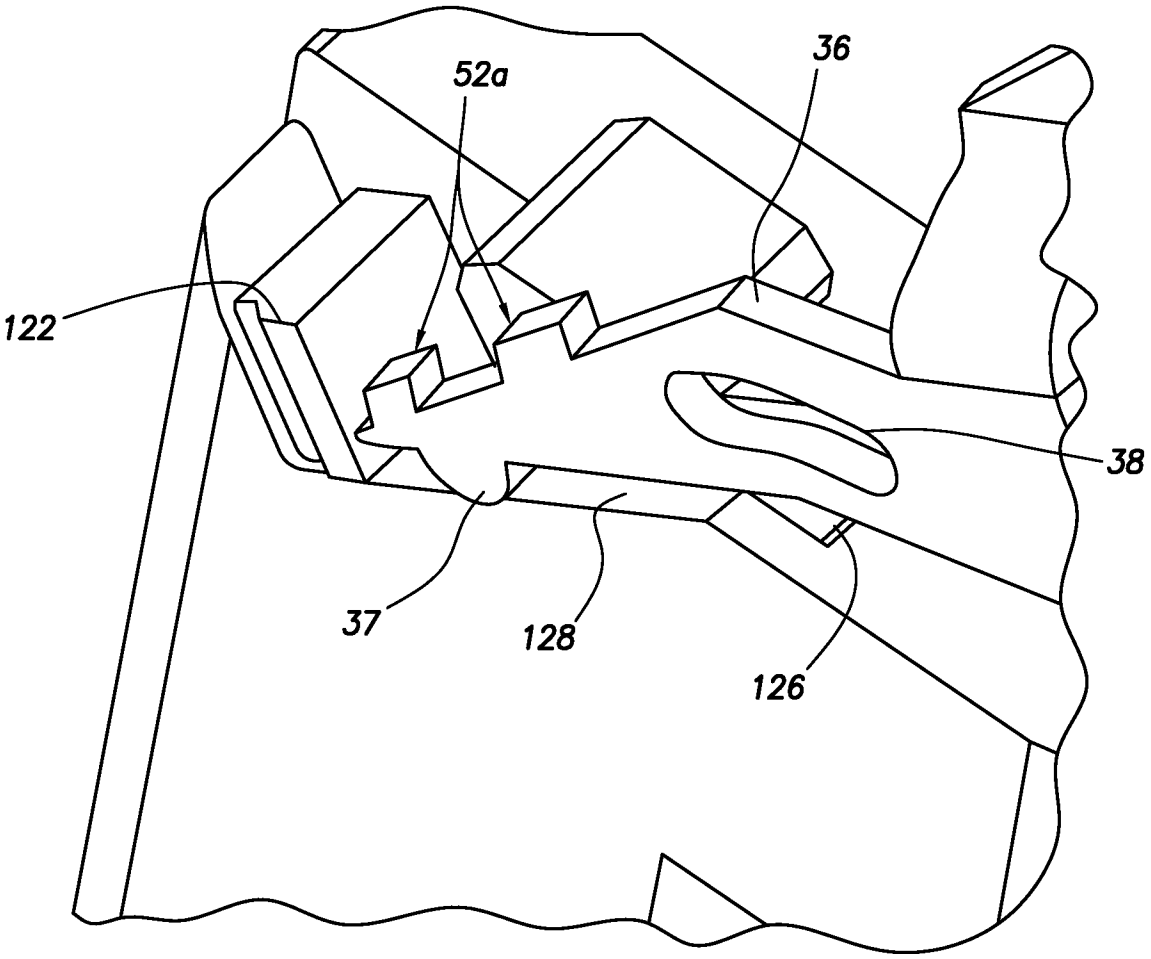
FIG. 6 is the partial detail as in FIG. 5 of selected elements of an exemplary training track assembly in a firing position according to aspects of the disclosure.

FIG. 5 is a partial detail of selected elements of an exemplary training track assembly for use with the auto-loading firearm of FIGS. 1-4 according to aspects of the disclosure. FIG. 6 is the partial detail as in FIG. 5 of selected elements of an exemplary training track assembly in a firing position according to aspects of the disclosure. As can be seen generally in FIGS. 3B and 4, the training trigger bar 36 engages a training track assembly 120 and moves between a non-firing position in FIG. 3B and a firing position in FIG. 4.

The training magazine 70, in the embodiment shown, includes a training track assembly 120. The training track assembly 120 includes a training track lever 122 biased towards an initial position by a biasing mechanism 124. The training track lever 122 slidingly engages a training track channel 126 which guides movement of the lever. The training trigger bar 36, when activated by the trigger assembly, slidingly engages a training track contact surface 128. In an embodiment, the training trigger bar 36 includes a sliding boss 37 for this purpose. The training trigger bar slides to depress the training track lever 122 and compress the training track biasing mechanism 124.

Figure 7:
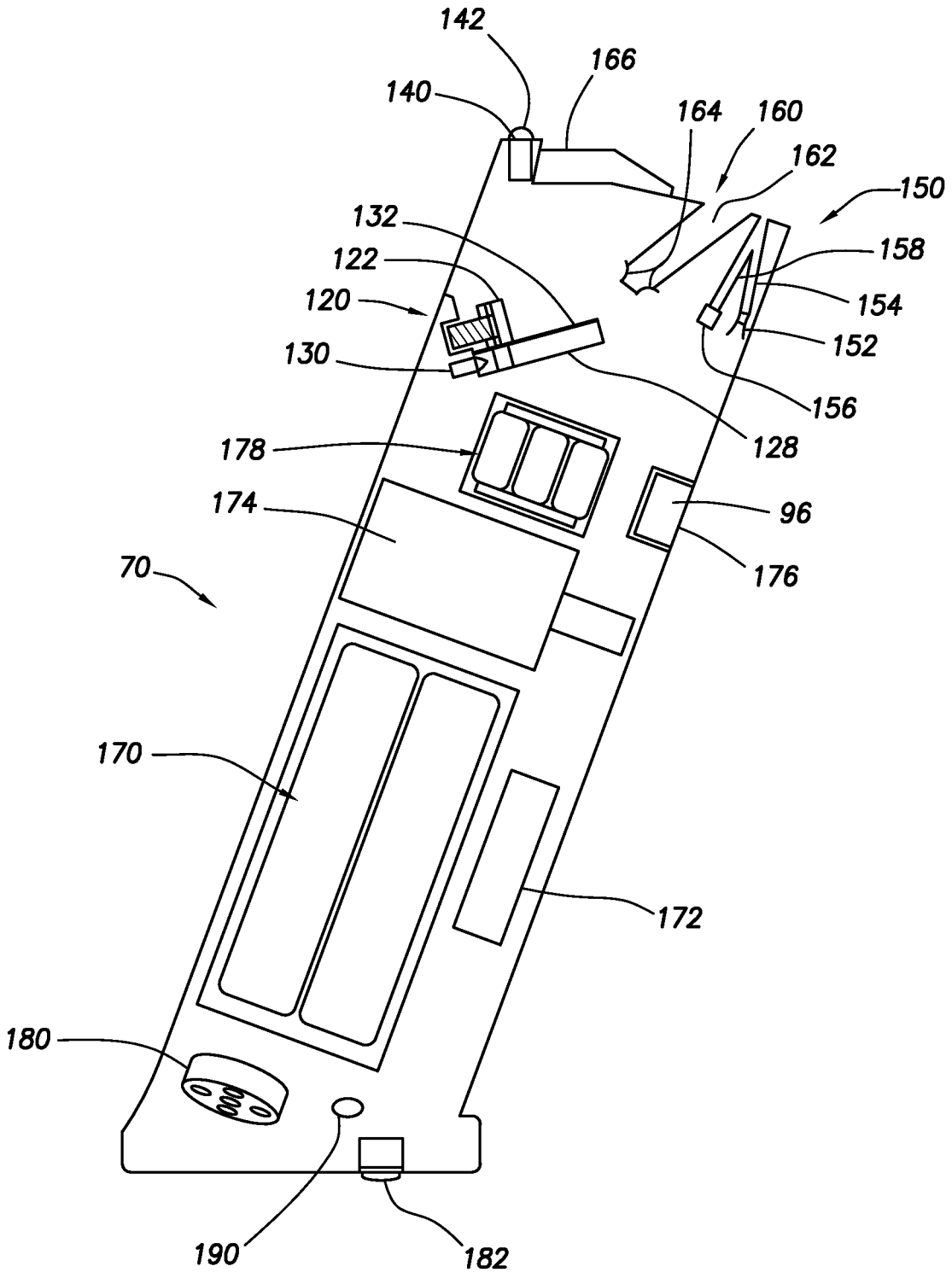
FIG. 7 is a sectional, elevation view of an exemplary training attachment including internal components according to aspects of the disclosure.
Figure 8:
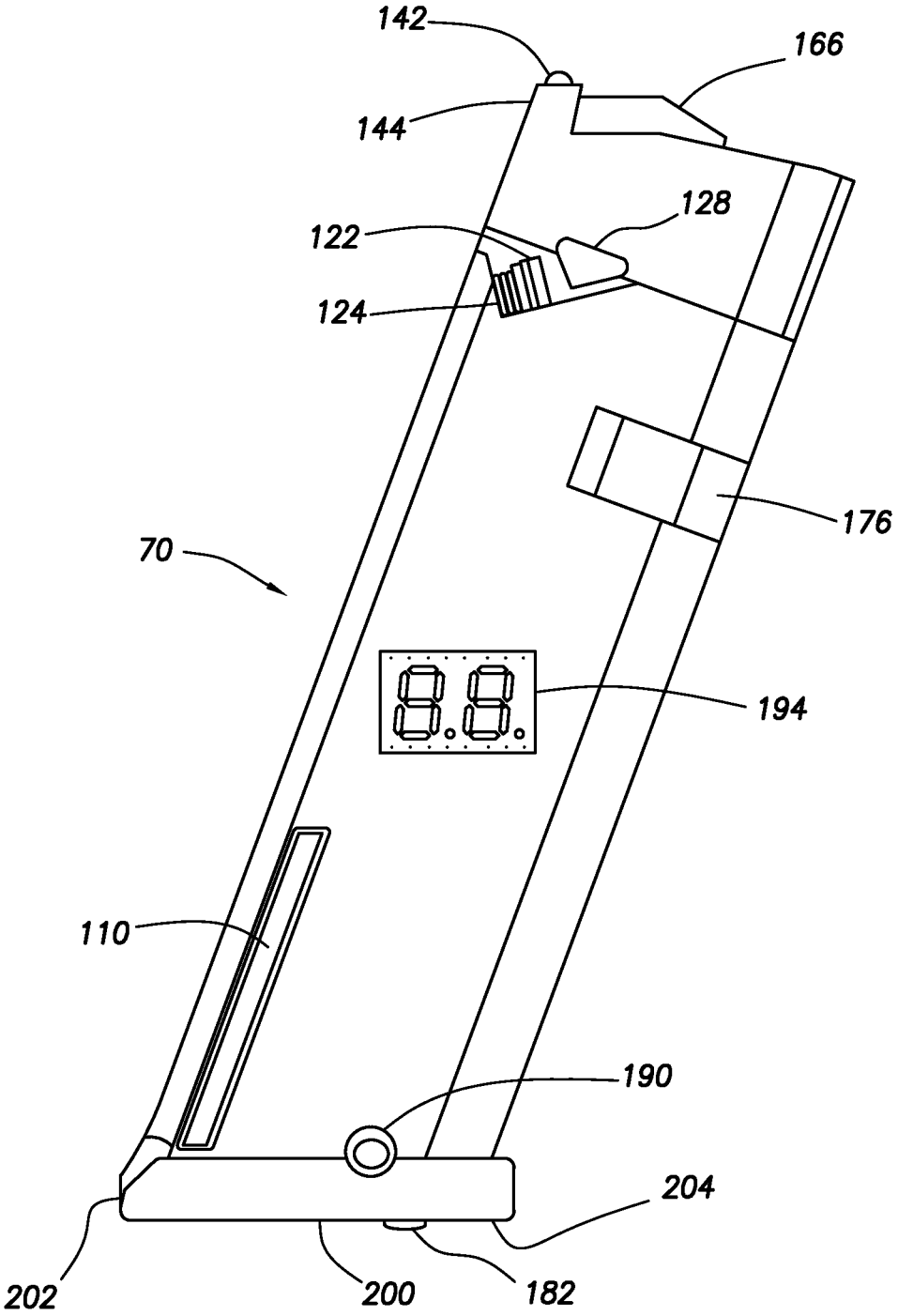
FIG. 8 is an elevational view of an exemplary training attachment according to aspects of the disclosure.

FIG. 7 is a sectional elevation view of an exemplary training attachment including internal components according to aspects of the disclosure. FIG. 8 is an elevational view of an exemplary training attachment according to aspects of the disclosure. The FIGS. 7 and 8 are discussed together.

FIG. 7 illustrates some internal and body components of an exemplary training magazine 70. The magazine 70 defines the training track lever channel 126 along which training track lever 122 slides. A training track retaining block 128 limits movement of the training track lever 122. A training track electric switch 130 is activated by movement of the training track lever 122 to a firing position. A training track lead 132 is provided to supply power and communication with the training track electric switch 130.

To register proper movement of the auto-loading firearm's slide or bolt while in training mode, a slide movement switch 140 having a switch dome 142 or the like is positioned to be depressed and released by movement of the slide or bolt. A live round block 144 is preferably provided at the upper end of the training magazine 70. The round block 144 prevents manual insertion of a live round into the training magazine. Further, any attempt to rack a round in the chamber, which may allow the training mode to operate, would also eject the round. Thus the live round block acts as an additional safety mechanism to prevent accidental discharge of the weapon. The round block can also provide a housing for the slide movement switch components.

A round sensor assembly 150 is provided in some embodiments. The round sensor assembly 150 includes a round sensor light emitter 152 positioned at the base of a light channel 154 defined in the magazine. Similarly, an optical sensor 156 is positioned at the base of an optical channel 158 defined in the magazine. The light emitter 152 emits light sufficient to reflect off of a round loaded in the barrel of the firearm, whereupon the optical sensor 156 detects the reflected light and transmits a signal to the microcontroller 172 that a round is loaded. In the exemplary case, the microcontroller 172 then prevents the standard lighting of LED lights 190 to indicate that the firearm is not fully safe for training. When a live round is absent or ejected, the optical sensor 156 will not signal the presence of a loaded round to the microcontroller 172. The design of the round sensor assembly can vary in terms of placement and orientation, depending on the physical configuration of the firearm, and can have more or fewer components and channels depending on design choice.

A training laser interface 160 is also illustrated having a lead channel 162, and positive and negative leads 164. Laser retaining structures, such as lips or rails 166, can be provided. The laser is both powered and activated by the training attachment through the microcontroller and the momentary switch 140. The power supply 170 is positioned in the training magazine (or other training attachment in other embodiments). In an embodiment, the laser is activated by a momentary switch 140 such that the laser provides a momentary laser burst at or near the time of pulling the trigger in training mode. Hence, the laser assembly indicates the occurrence of training fire, denotes the location where a round would strike, and can work with commercially available laser-detecting targets.

Various electrical components can be mounted in the training magazine such as a power supply 170, a microcontroller 172, circuit wiring (not shown), a magazine release lead or sensor 176, a capacitor bank 178, an RFID or other tag, and other electronic components which will be obvious to those of skill in the art. Each of the electrical assemblies is operably connected to a power supply and the microcontroller. The microcontroller controls functionality of the various sensors and electrical components which can communicate sensed conditions to the microcontroller. For example, the microcontroller can be used to signal error conditions, provide a count of rounds fired, activate other feedback mechanisms such as the recoil solenoid and the speaker, control said mechanisms to provide specific amounts of recoil, noise, or rounds, simulate firearm malfunctions, interface with external training components including scoring devices and position detectors, and maintain training records among other uses.

A speaker 180 can be provided for emitting training sounds such as a simulated firearm report. Buttons or other controls 182 can be mounted such that they are accessible from the exterior of the training magazine while the magazine is inserted into the firearm. A recoil solenoid 174 can be provided for simulating firearm recoil. Recoil and sound mechanisms can be keyed to the "round counting" of the microcontroller such that the microcontroller produces sound and recoil when the training magazine is "loaded," but does not provide such feedback after the training magazine is "emptied." A "re-set" button or the like can extend from the training magazine to allow the user to re-load and re-use the magazine.

LED lights or other active indicators 190 can be positioned on the magazine 70 and elsewhere on the firearm. For example, FIG. 1 shows a plurality of LED sockets 192. The indicators can communicate that the firearm is in training mode. The indicators can be used to indicate battery charge level and option configuration status. Active indicators can be infrared indicators, invisible to the naked eye but visible through an infrared viewing device. This may be useful in group training and tactics exercises. The indicators can provide information to the user by colored lights, color-changing lights, flash or blink patterns, etc.

An informational display 194 can be provided for displaying data to the user. Such data can include number of simulated rounds available, battery charge status, error codes, and user option selections. In an embodiment, the display is visible when the training magazine is removed from the firearm. The display (as well as the other electronic components discussed herein) can be positioned anywhere on the training magazine.

The system can also be used in logistics training. For example, the training magazine (or other training attachment) can be programmed, via the microcontroller, to allow a user to "re-load" the magazine a set number of times equaling the number of magazines the user would have in a live fire situation. Further, the microcontrollers of multiple firearms can be programmed such that, in toto, they allow multiple users a selected number of rounds or re-loads by the users, thereby allowing "sharing" of ammunition among users with a maximum amount of ammunition available to the group. Also, an on-site, electronic, virtual ammunition depot can be used in conjunction with the training firearms such that, upon exhausting his selected number of training rounds or magazines, the user is required to physically go to the ammunition depo to re-arm themselves with another set of training rounds or magazines. For example, when out of training rounds, as indicated by the firearm in training mode (by indicators, feedback mechanisms, etc.), a user re-arms by taking the training magazine (or attachment) to the ammunition depo. An electronic interaction between the user's magazine and the depot effectively "re-loads" the training magazine with a selected number of training rounds and/or magazines.

Multiple virtual depots can be used in conjunction, connected or networked to one another and/or a central computer for communication and coordination, such that multiple smaller groups of users have access to a central ammunition depot with a selected amount of ammunition. The virtual depots (or networked computer) can track and control: ammunition use per user, ammunition use per group of users (e.g., a team, a platoon), per firearm, per type of firearm or ammunition (e.g., both semiautomatic handguns and automatic rifles), etc. The depot can limit the total amount of ammunition available (for one or multiple types of firearm) for distribution to the group, such that the group is trained in logistical use of limited available ammunition. For prolonged training exercises, the virtual depot can also mimic restocking and resupply.

The training magazine can include a base plate 200, base plate hinge 202, and base plate release 204 to allow access to the magazine internal components. A magazine release mechanism 96 is discussed above herein. Similarly, the push bar 110 is described above herein. Various cavities, channels, mountings, and alignment and positioning features can be defined in and on the magazine, internally and externally, to allow for placement of sensors, electronics, lights and indicators, and other components.

Figure 9A:
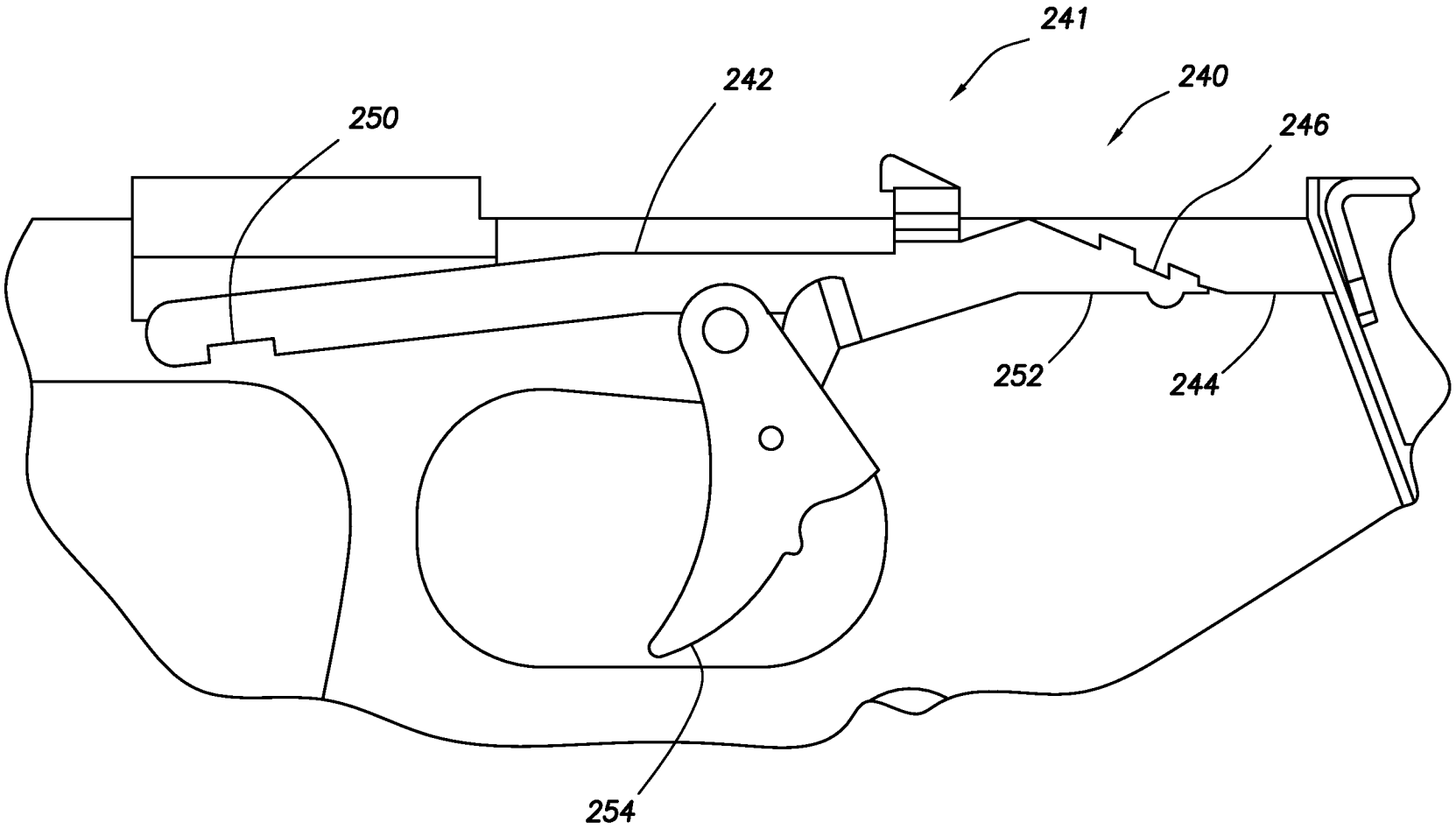
FIGS. 9A-B are elevational sectional details of an alternate design for a multi-component trigger bar assembly for an auto-loading firearm in accordance with aspects of the disclosure, with FIG. 9A showing the firearm in a live fire position and FIG. 9B showing the firearm in a training position.
Figure 9B:
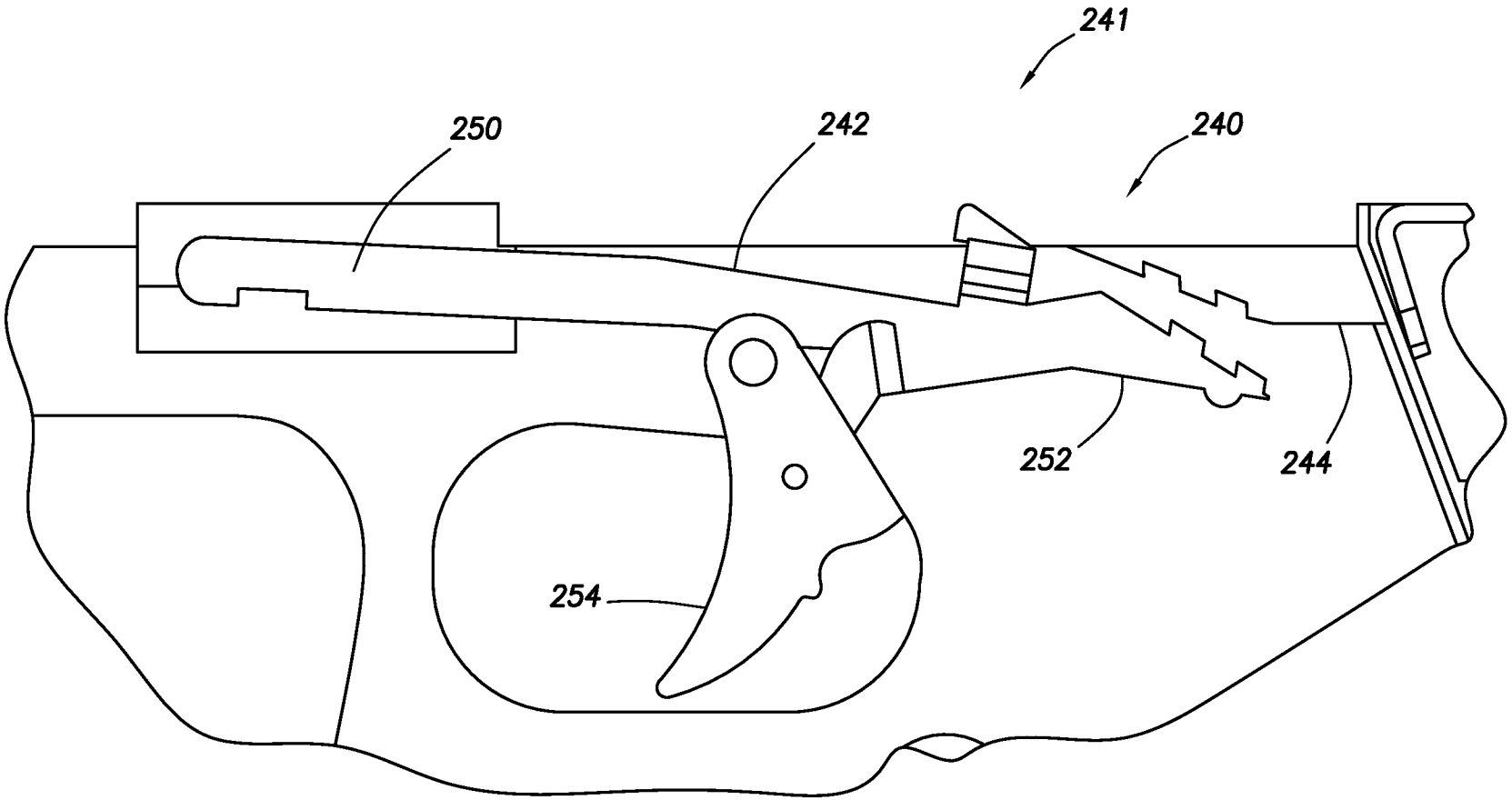

FIGS. 9A-B are elevational sectional details of an alternate design for a multi-component trigger bar assembly 240 for an auto-loading firearm 241 in accordance with aspects of the disclosure. FIG. 9A shows the training trigger bar 242 in a live fire position and FIG. 9B showing the training trigger bar 242 in the training position. In this embodiment, a "split" trigger bar assembly 240 is used, similar to that described with respect to FIGS. 1-8, having a training trigger bar 242 which cooperates with a firing trigger bar 244 at toothed joint 246. The training trigger bar 242 extends to a selector switch 250 which is moveably attached to the firearm and is movable between a live fire position, seen in FIG. 9A, and a training position, seen in FIG. 9B.

The selector switch 250 of the shown embodiment is integral to the training trigger bar 242, constituting or defined by the forward end of the bar. The firearm is shifted between live fire and training modes by operation of the selector switch 250, namely by lifting the front end of the selector switch. Lifting of the selector switch 250 pivots the training trigger bar 242, lowering the joint end 252 of the training trigger bar and disengaging the training and firing trigger bars 242 and 244 along joint 246.

The selector switch 250 can be moved between positions manually or automatically, with a force acting from above or below the trigger bar. In an embodiment, the selector switch is activated by attaching a training attachment 252 to the upper portion of the firearm. For example, a training attachment (not shown) can be a top-mounted, side-mounted, or bottom-mounted training attachment such as a sighting assembly, tactical lighting assembly, laser targeting assembly, etc., having a hook, slide, extension, or other mechanism which interacts with and lifts the selector switch 250. The selector switch 250 is preferably biased toward the live fire position by a biasing assembly (not shown) and is moved to and maintained in the training position by proper attachment of the training attachment 252. Upon removal of the training attachment 252, the selector switch is preferably returned to the live fire position by the biasing assembly. In alternate embodiments, the selector switch can be returned to the live fire position upon removal of the attachment and another user action, such as movement of a lever, switch, etc. The trigger 254 and other firearm components operate similarly to corresponding firearm components described above herein and so are not detailed here.

Figure 10A:
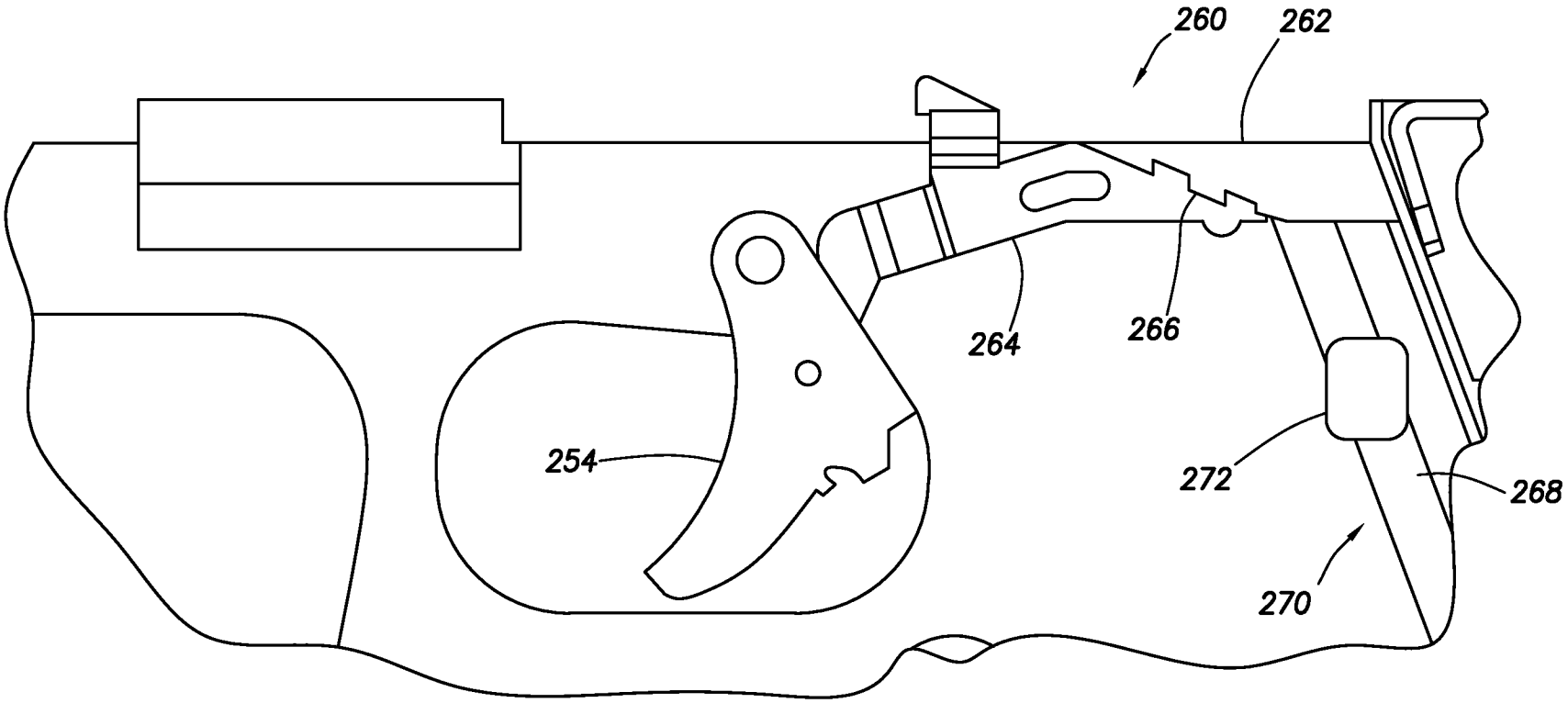
FIGS. 10A-B are elevational sectional details of an alternate design for a multi-component trigger bar assembly in an auto-loading firearm in accordance with aspects of the disclosure, with FIG. 10A showing the firearm in a live fire position and FIG. 10B showing the firearm in a training position.
Figure 10B:
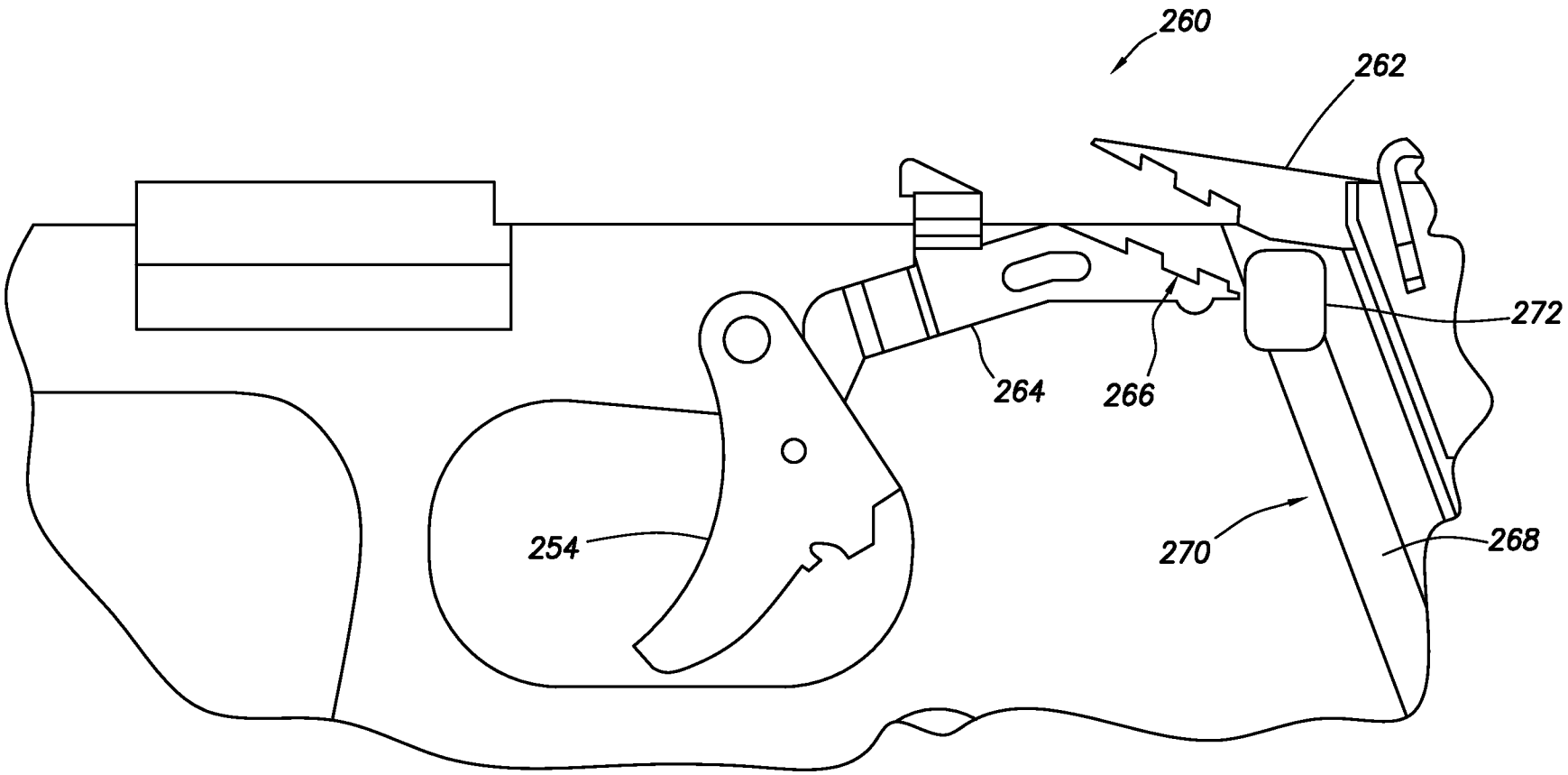

FIGS. 10A-B are elevational sectional details of an alternate design for a multi-component trigger bar assembly 260 in an auto-loading firearm 261 in accordance with aspects of the disclosure, with FIG. 10A showing the firing trigger bar 262 in a live fire position and FIG. 10B showing the firing trigger bar 262 in the training position. In this embodiment, a "split" trigger bar assembly 260 is used, similar to that described with respect to FIGS. 1-8, having a training trigger bar 264 which cooperates with a firing trigger bar 262 at joint 266. The firing trigger bar 262 is activated by the selector switch 270. In the shown embodiment, the firing trigger bar 262 extends across or into the training track channel 268. The training track lever 272 is slidable along the training track channel 268 and moves between a live fire position, shown in FIG. 10A, and a training position, shown in FIG. 10B. Similarly, such movement results in corresponding movement of the selector switch between live fire and training positions.

In an embodiment, the selector switch 270 is activated and held in the training position by attachment of a training attachment such as a training magazine as described above herein. For example, the training magazine can have a push-bar cooperating with a push-bar channel and activating a transfer lever which in turn activates the training track lever.

In some embodiments, the firing trigger bar 262 is biased by a biasing assembly (not shown) toward the live fire position. In other embodiments, the selector switch or training track lever is so biased. Attachment and detachment of a training attachment preferably automatically results in movement of the selector switch 270 and firing trigger bar 262 between positions. In alternate embodiments, the selector switch can be returned to the live fire position upon a user-action such as movement of a lever, switch, etc. The trigger 274 and other firearm components operate similarly to corresponding components described above herein and so are not detailed here.

Figure 11:
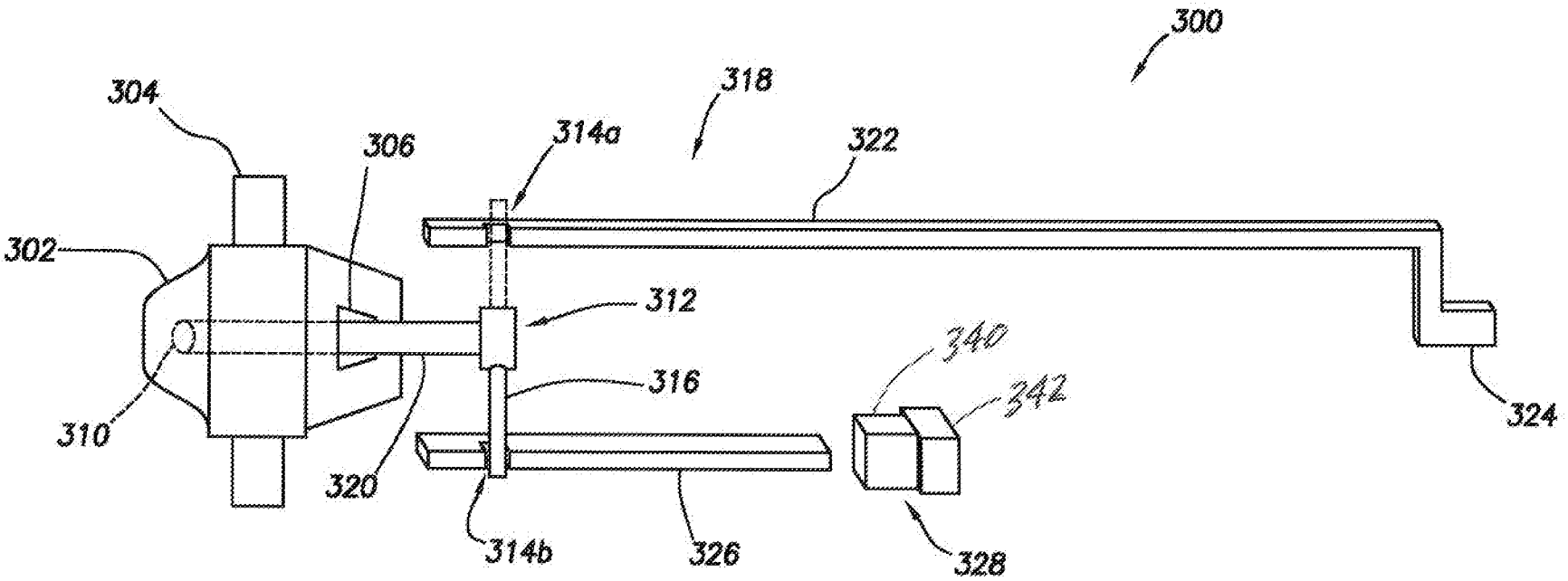
FIG. 11 is a top partial view of an exemplary embodiment of a three-part transfer bar assembly for use in a firearm according to aspects of the disclosure.

FIG. 11 is a top partial schematic view of an exemplary embodiment of a multiple-part transfer bar assembly for use in an auto-loading firearm according to aspects of the disclosure.

A trigger 302 rotates about a trigger pivot pin 304. A transfer bar assembly 318 has multiple transfer bars, namely, a first, second, and third transfer bar, 320, 322, and 326 respectively. The transfer bar assembly functions similarly to a transfer or trigger bar in many auto-loading firearm designs. That is, the transfer bar assembly transfers movement of the trigger to movement of a sear 324 to release the firing mechanism of the firearm. In the embodiment shown, the transfer bars move (at least) longitudinally within the firearm as is known in the art.

The first transfer bar 320, or trigger transfer bar, is attached to the trigger 302 such that depression of the trigger results in corresponding movement of the first transfer bar 320. An exemplary connection, as shown, has the first transfer bar 320 extends into a cooperating cavity 306 defined in the trigger 302. In an embodiment, the first transfer bar 320 is rotatably attached to the trigger to allow selective rotation of the first transfer bar in response to activation of a selector switch lever 310 or other actuator.

The second transfer bar 322 is selectively and releasably attachable to the selector switch 312. In the embodiment shown, the connection is a selector switch notch 314*a* defined in the second transfer bar 322 which cooperates with the selector switch arm 316. The second transfer bar 322, or live fire transfer bar, further defines a sear 324. The sear and live fire transfer bar are shown as an integral piece but other designs are known in the art. Movement of the first transfer bar 322 causes similar movement in the second transfer bar 322 when the selector switch 312 is operably connected to the second trigger bar. When not engaged with the selector switch 312, the second transfer bar 322 remains stationary upon depression of the trigger 302, thereby preventing discharge of live ammunition from the firearm.

The third transfer bar 326 is selectively and releasably attachable to the selector switch 312. Operation of the selector switch lever 310 rotates the selector switch arm 316 between an engaged position with the second transfer bar 322 (indicated by dashed lines) and an engaged position with the third transfer bar 326. In the embodiment shown, the connection is a selector switch notch 314*b* defined in the third transfer bar 326 which cooperates with the switch arm 316. The third transfer bar 326 is aligned with a trigger resetting mechanism 328 such that movement of the third transfer bar in response to depression of the trigger 302 results in activation of the resetting mechanism and automatic return of the trigger 302 to its home position. For example, the trigger resetting mechanism can comprise a button 340 for impingement by the third transfer bar, with a biasing assembly (not shown) trapped between the button 340 and a socket defined in a base 342 for returning the third transfer bar 326, first transfer bar 320 and trigger 302 to their home positions. Other biasing assemblies are known in the art.

The first transfer bar 320 is connected to the selector switch assembly 312. The selector switch assembly is operable to selectively engage either the second transfer bar 322 or the third transfer bar 326. Other arrangements are possible, such as selective engagement by the selector switch of the first transfer bar 320. Further, in the arrangement shown, the first transfer bar 320 moves (rotates) during activation of the selector switch. Instead, activation of the selector switch can move the second and/or third transfer bars. The second and third transfer bars as shown do not move laterally and are arranged generally in parallel. Alternate embodiments can relative movement of the second and third transfer bars with respect to each other and/or the firearm frame during activation of the selector switch. For example, activating the selector switch could move the second transfer bar out of alignment with the sear and/or move the third transfer bar into alignment with the trigger resetting mechanism.

The selector switch assembly shown is exemplary. Alternative designs for the assembly will be apparent to those of skill in the art. The assembly can be manually operated or automatic, such as by attachment of a training attachment. The assembly can use a rotary lever as shown, or a push button, slidable pin and groove, push bar, or other known mechanisms. As an example, the selector switch arm 316 could instead slide laterally through a cooperating hole or passage in or on the first transfer bar and through aligned holes on opposite sides of the firearm. Pressing the arm (or pin) extending from the firearm operates to switch modes, alternately connecting the arm 316 to the second and third transfer arms. Detents or profiles on the arm 316 would allow disengagement of the arm from the opposite transfer bar. Further, the assembly can be operable to simply move between the two engaged positions or can have additional positions (e.g., disengaged with both the second and third transfer bars).

In an embodiment, an additional safety mechanism can prevent movement of the second transfer bar 322 and/or sear 324 when the selector switch 312 is disengaged from the second transfer bar 322.

The notches 314*a* and 314*b*, are exemplary. The releasable and selective connection between the switch and transfer bars can be any releasable connection known in the art, such as a releasable latch, pin and groove, cooperating profiles, pin and slot, hook and eye, friction fit, etc. Further, the connection can include additional parts to those in the illustrated embodiment for aligning the switch and bar, connecting the switch and bar, securing the switch and bar, and/or locking the switch and bar together. For example, a manual lever or the like can be added to allow a user to lock the switch into engagement with the live fire bar and/or training mode bar (such that alternating between modes requires an additional positive action be taken by the user).

The following disclosure is provided in support of the methods claimed or which may be later claimed. Specifically, this support is provided to meet the technical, procedural, or substantive requirements of certain examining offices. It is expressly understood that the portions or actions of the methods can be performed in any order, unless specified or otherwise necessary, that each portion of the method can be repeated, performed in orders other than those presented, that additional actions can be performed between the enumerated actions, and that, unless stated otherwise, actions can be omitted or moved. Those of skill in the art will recognize the various possible combinations and permutations of actions performable in the methods disclosed herein without an explicit listing of every possible such combination or permutation. It is explicitly disclosed and understood that the actions disclosed, both herein below and throughout, can be performed in any order (xyz, xzy, yxz, yzx, etc.) without the wasteful and tedious inclusion of writing out every such order.

Further, disclosed herein are methods comprising steps as indicated. 1. A method of switching an auto-loading firearm between a live fire mode in which the firearm is operable to discharge rounds of ammunition and a training mode wherein the firearm is prevented from firing rounds of ammunition, the method comprising: moving a selector switch from a live fire position to a training mode position; in response to moving the selector switch to the training mode position, relatively moving a first transfer bar out of alignment with a cooperating second transfer bar, the first transfer bar attached to a trigger of the firearm, the second transfer bar for moving a sear of the firearm during firearm discharge; moving a trigger resetting mechanism and the first transfer bar into alignment; and resetting the depressed trigger using the trigger resetting mechanism, in response to depression of the trigger with the selector switch in the training mode position. 2. The method of 1, further comprising: returning the selector switch to the live fire position from the training mode position; in response to returning the selector switch to the live fire position, moving the first transfer bar into alignment with the cooperating second transfer bar. 3. The method of 2, further comprising, after returning the selector switch to the live fire position: depressing the trigger; in response to depressing the trigger, moving the first transfer bar, the first transfer bar attached to the trigger; in response to moving the first transfer bar, moving the aligned second transfer bar, the second transfer bar for moving a sear of the firearm to discharge the firearm. 4. The method of 1, further comprising, after moving the selector switch to the training mode position: depressing the trigger; in response to depressing the trigger, moving the first transfer bar, the first transfer bar attached to the trigger; in response to moving the first transfer bar, engaging the trigger resetting mechanism with the first transfer bar. 5. The method of 1, further comprising: releasably connecting the first and second transfer bars. 6. The method of 1, wherein relatively moving the first transfer bar out of alignment with the cooperating second transfer bar further comprises: moving the first transfer bar using the selector switch. 7. The method of 1, further comprising: removably attaching a training device to the firearm, the movement of the selector switch in response to attaching the training device. 8. The method of 1 further comprising: biasing the selector switch toward the live fire position. 9. The method of 1, further comprising: biasing the first and second transfer bars toward relative alignment. 10. The method of 7, wherein the selector switch is movably mounted either on a frame of the firearm or on the training device. 11. The method of 7, wherein the trigger resetting mechanism is mounted either on a frame of the firearm or on the training device. 12. The method of 1, further comprising, with the selector switch in the training mode position: activating a recoil mechanism or emitting a sound in response to depression of the trigger. 13. The method of 1, further comprising, with the selector switch in the training mode position: automatically tracking virtual rounds available or expended, and simulating a firearm malfunction and preventing expending of further virtual rounds until the simulated malfunction is corrected.

For further disclosure on the operation and parts of exemplary hammer-type and striker-type self-loading firearms, see the following references which are each incorporated herein by reference for all purposes including support of the claims: *GLOCK Semiautomatic "SAFE ACTION" Pistols, Glock* 17, 19, 20, 21, 22, 23 & 17*L, Glock Armorer's Manual, Glock, Inc.* (January 1992), 60 pages; *Springfield Armory, XD Operation and Safety Manual*, Springfield, Inc. (2008), 45 pages; *HK USP Pistol Armorers Instruction, Heckler Koch,* 39 *pages; SIGARMS Training, P*220 *Combat Pistol, Armorers Manual*, SIGARMS, 61 pages; *SIG SAUER, P*320*, Owner's Manual: Handling & Safety Instructions*, Sig Sauer, Inc., 68 pages; U.S. Pat. No. 8,156, 677 B2 to Glock, issued Apr. 17, 2012, entitled "Assemblies and Firearms Incorporating Such Assemblies;" U.S. Pat. No. 5,655,326, to Levavi, et al., issued Aug. 12, 1997, entitled "Method of Deploying a Weapon Utilizing the "Glock System" which Provides Maximum Safety and Readiness."

Use of the term "training" throughout is not intended as a limitation in purpose or use of the apparatus or method. Certainly the disclosure also addresses other purposes and uses, such as operational safety, educational use of firearms, etc. The term "training" is used as a short-hand term and encompasses any purposes applicable to provision and use of an auto-loading firearm having a live fire mode in which ammunition can be discharged and a "non-live fire" mode in which discharge of live ammunition is prevented but wherein some or all aspects of the self-loading mechanism still operate such that the user does not have to manually reset (e.g., pull the slide, push the trigger forward, etc.) after "firing" the firearm in the non-live fire mode.

The words or terms used herein have their plain, ordinary meaning in the field of this disclosure, except to the extent explicitly and clearly defined in this disclosure or unless the specific context otherwise requires a different meaning.

If there is any conflict in the usages of a word or term in this disclosure and one or more patent(s) or other documents that may be incorporated by reference, the definitions that are consistent with this specification should be adopted.

The words "comprising," "containing," "including," "having," and all grammatical variations thereof are intended to have an open, non-limiting meaning. For example, a composition comprising a component does not exclude it from having additional components, an apparatus comprising a part does not exclude it from having additional parts, and a method having a step does not exclude it having additional steps. When such terms are used, the compositions, apparatuses, and methods that "consist essentially of" or "consist of" the specified components, parts, and steps are specifically included and disclosed.

As used herein, the words "consisting essentially of," and all grammatical variations thereof are intended to limit the scope of a claim to the specified materials or steps and those that do not materially affect the basic and novel characteristic(s) of the claimed disclosure.

The indefinite articles "a" or "an" mean one or more than one of the component, part, or step that the article introduces. The terms "and," "or," and "and/or" shall be read in the least restrictive sense possible. Each numerical value should be read once as modified by the term "about" (unless already expressly so modified), and then read again as not so modified, unless otherwise indicated in context.

While the foregoing written description of the disclosure enables one of ordinary skill to make and use the embodiments discussed, those of ordinary skill will understand and appreciate the existence of variations, combinations, and equivalents of the specific embodiments, methods, and examples herein. The disclosure should therefore not be limited by the above described embodiments, methods, and examples. While this disclosure has been described with reference to illustrative embodiments, this description is not intended to be construed in a limiting sense. Various modifications and combinations of the illustrative embodiments as well as other embodiments of the disclosure will be apparent to persons skilled in the art upon reference to the description. It is, therefore, intended that the appended claims encompass any such modifications or embodiments.

The particular embodiments disclosed above are illustrative only, as the present disclosure may be modified and practiced in different but equivalent manners apparent to those skilled in the art having the benefit of the teachings herein. It is, therefore, evident that the particular illustrative embodiments disclosed above may be altered or modified and all such variations are considered within the scope of the present disclosure. The various elements or steps according to the disclosed elements or steps can be combined advantageously or practiced together in various combinations or sub-combinations of elements or sequences of steps to increase the efficiency and benefits that can be obtained from the disclosure. It will be appreciated that one or more of the above embodiments may be combined with one or more of the other embodiments, unless explicitly stated otherwise. Furthermore, no limitations are intended to the details of construction, composition, design, or steps herein shown, other than as described in the claims.

It is claimed:

1. An auto-loading firearm comprising:

a trigger movable between a home position and a depressed position;

a split trigger bar having a first portion movable in response to movement of the trigger, and a second portion releasably attachable to the first portion;

a selector switch for alternately releasing and attaching the first and second portions to one another;

the first and second portions of the trigger bar, when attached to one another, moving simultaneously when the trigger is moved to the depressed position;

when the first and second portions of the trigger bar are released from one another, movement of the trigger to the depressed position moving the first portion of the trigger bar and not moving the released second portion of the trigger bar; and a trigger resetting mechanism for automatically moving the trigger to the home position only when the first and second portions of the trigger bar are released from another.

2. The auto-loading firearm of claim 1, wherein the trigger resetting mechanism is selectively engageable with the first portion of the trigger bar.

3. The auto-loading firearm of claim 2, wherein the trigger resetting mechanism engages the first portion of the trigger bar when the first and second portions of the trigger bar are released from one another, and wherein the trigger resetting mechanism does not engage the first portion of the trigger bar when the first and second portions are attached to one another.

4. The auto-loading firearm of claim 1, wherein the selector switch is movable in response to one of the following: user manipulation of the selector switch, detachment or attachment of a training device from the firearm, and activation of an ammunition loading mechanism.

5. The auto-loading firearm of claim 1, the first and second portions of the trigger bar, when released from one another, spaced apart from one another.

6. The auto-loading firearm of claim 1, further comprising a biasing assembly, the biasing assembly biasing the first and second portions of the trigger bar towards an engaged position.

7. The auto-loading firearm of claim 1, wherein the selector switch releases the first and second portions of the trigger bar from one another by moving one of the first or second portions pivotally, rotatably, or slidably.

8. The auto-loading firearm of claim 1, wherein the trigger resetting mechanism provides the user with realistic trigger pull feedback.

9. The auto-loading firearm of claim 1, wherein the trigger resetting mechanism comprises a spring-biased lever for applying force on the first portion of the trigger bar.

10. An auto-loading firearm having a live fire mode and a training mode, the auto-loading firearm comprising:

a trigger movable between a home and a depressed position;

a trigger resetting mechanism for automatically resetting the trigger to the home position, the trigger resetting mechanism selectively engageable with the trigger;

the trigger, when the firearm is in the live fire mode, operably connected to discharge the firearm and disengaged from the trigger resetting mechanism; and the trigger, when the firearm is in the training mode, inoperable to discharge the firearm and engaging the trigger resetting mechanism.

11. The auto-loading firearm of claim 10, further comprising a selector switch assembly for moving the firearm between the live fire and training modes, the selector switch assembly operable to selectively engage the trigger with the trigger resetting mechanism when in the live fire mode.

12. The auto-loading firearm of claim 10, wherein, when in the live fire mode, the trigger is connected to the sear by a trigger bar assembly.

13. The auto-loading firearm of claim 12, wherein the trigger bar assembly comprises a split trigger bar having a first bar connected to the trigger and a second bar connected to the sear.

14. The auto-loading firearm of claim 13, wherein, when in the live fire mode, the first and second bars are connected to one another.

15. The auto-loading firearm of claim 14, wherein, when in the training mode, the first and second bars are disengaged from one another.

16. The auto-loading firearm of claim 14, wherein, when in the training mode, the first and second bars are spaced apart from one another.

17. The auto-loading firearm of claim 10, wherein, when in the live fire mode, the trigger is operably connected to a sear, the sear for discharging the firearm.

18. The auto-loading firearm of claim 17, wherein, when in the training mode, the trigger is disconnected from the sear.

* * * * *